US008801315B2

(12) United States Patent
Dwyer

(10) Patent No.: US 8,801,315 B2
(45) Date of Patent: Aug. 12, 2014

(54) AIRLESS COSMETICS APPLICATOR WITH AIRTIGHT SEALING DUAL CAP

(75) Inventor: Walter Dwyer, Santa Monica, CA (US)

(73) Assignee: Cosmopak USA, LLC, Port Washington, NY (US)

( * ) Notice: Subject to any disclaimer, the term of this patent is extended or adjusted under 35 U.S.C. 154(b) by 504 days.

(21) Appl. No.: 13/134,334

(22) Filed: Jun. 3, 2011

(65) Prior Publication Data

US 2011/0293354 A1 Dec. 1, 2011

Related U.S. Application Data

(63) Continuation-in-part of application No. 12/925,164, filed on Oct. 14, 2010, now Pat. No. 8,360,673.

(60) Provisional application No. 61/279,008, filed on Oct. 14, 2009.

(51) Int. Cl.
*A46B 17/04* (2006.01)

(52) U.S. Cl.
USPC ..... 401/269; 401/171; 401/277

(58) Field of Classification Search
USPC ..... 401/171, 172, 174, 269–270, 277–279
See application file for complete search history.

(56) References Cited

U.S. PATENT DOCUMENTS

| | | | | |
|---|---|---|---|---|
| 1,191,432 | A | 7/1916 | Jones | |
| 4,416,391 | A | 11/1983 | Sarrazin | |
| 4,436,219 | A | 3/1984 | Reutter | |
| 4,543,913 | A | 10/1985 | Wilkeson | |
| 4,674,904 | A | 6/1987 | Buck | |
| 4,764,044 | A | 8/1988 | Konose | |
| 4,902,154 | A | 2/1990 | Valenza | |
| 5,012,970 | A | 5/1991 | Kucherer | |
| 5,381,919 | A | 1/1995 | Griffin | |
| 5,395,004 | A | 3/1995 | Griffin | |
| 5,540,347 | A | 7/1996 | Griffin | |
| 5,551,789 | A * | 9/1996 | Okawa et al. | 401/199 |
| 5,569,849 | A | 10/1996 | Cummings | |
| 5,615,793 | A | 4/1997 | Muller | |
| 5,873,478 | A | 2/1999 | Sullivan | |
| 5,971,647 | A * | 10/1999 | Loulourgas | 401/202 |
| 6,176,632 | B1 * | 1/2001 | Kageyama et al. | 401/186 |
| 6,213,331 | B1 | 4/2001 | Morgan | |
| 6,702,158 | B2 * | 3/2004 | Kageyama et al. | 222/386 |
| 6,745,781 | B2 | 6/2004 | Gueret | |
| 6,935,536 | B2 | 8/2005 | Tardif | |
| 7,309,185 | B2 | 12/2007 | Thorpe | |

(Continued)

*Primary Examiner* — David Walczak
*Assistant Examiner* — Jennifer C Chiang
(74) *Attorney, Agent, or Firm* — Thomas A. O'Rourke; Bodner & O'Rourke, LLP

(57) ABSTRACT

An airless applicator may deliver high/low viscosity liquids or semi-liquids, and contains a valve controlling flow between a product reservoir and an intermediate pooling area, while a narrow opening between the intermediate pooling area and a product dispensing chamber controls flow therebetween. This arrangement prevents backflow to the product reservoir, precluding an influx of contamination therein. Product delivery is by specially adapted applicator heads. In one embodiment, a plurality of prongs, and openings into the product dispensing chamber, permit application of mascara onto eyelashes. Alternating prong heights increases effectiveness in applying mascara onto all sides of a user's lashes. Other applicator heads are configured for lip product applications such as for lipstick, and for eye products such as eyeliner and eye shadow. An air-tight sealing cap having a spring biased inner cap member may prevent moisture from escaping from the product dispensing chamber and prevent entry of contaminants therein.

5 Claims, 17 Drawing Sheets

(56) References Cited

U.S. PATENT DOCUMENTS

| | | | | |
|---|---|---|---|---|
| 7,614,814 | B2 * | 11/2009 | Lee et al. | 401/269 |
| 8,499,985 | B2 | 8/2013 | Lehmkuhl | |
| 2009/0218306 | A1 | 9/2009 | Menchel | |
| 2010/0044386 | A1 | 2/2010 | Samson | |
| 2011/0186573 | A1 | 8/2011 | Tardif | |
| 2012/0000880 | A1 | 1/2012 | Im | |
| 2013/0193170 | A1 | 8/2013 | Lehmkuhl | |

* cited by examiner

AIRLESS COSMETICS APPLICATOR WITH AIRTIGHT SEALING DUAL CAP

CROSS REFERENCES TO RELATED APPLICATIONS

This application is a continuation-in-part of U.S. patent application Ser. No. 12/925,164, having the title "Dual-Reservoir Mascara Applicator With Dispersive Product Delivery, filed Oct. 14, 2010, now U.S. Pat. No. 8,360,673 which claimed priority on U.S. Provisional Application Ser. No. 61/279,008, filed on Oct. 14, 2009, having the title, "Applicator Device with Dispersive Product Delivery," with the disclosures of each being incorporated herein by reference.

FIELD OF THE INVENTION

The present invention relates to improvements in apparatus used for the application of liquids, creams, gels and the like, and more particularly to apparatus which comprise a valved dual reservoir system, and are capable of providing airless delivery of cosmetic products.

BACKGROUND OF THE INVENTION

There is a need to have a means of applying liquids, creams, ointments, lotions, gels, oils, paste, and the like, to a person's face, and other areas, and where such applications may be made in generous quantities across a large surface area, there is also a need for a delivery system that provides careful control of the product being dispensed, while delivering that large quantity. Conversely, where the product needs to be dispensed with care due to the delicacy of the receiving surface, or where product needs to be applied only in specific locations while excluding adjacent surfaces, or where the high cost of product dictates the minimization of waste, the means and method of application acquire increasing importance. It is also of increasing importance to protect the product from the introduction of contaminants, and from loss of product moisture to the air.

Examples of the instances where such diligence is required in the application of a product are diverse, and may include the following: application of off-the-shelf skin creams or moisturizing lotions; ointments for treatment of dermatological conditions, burn treatment medicines, anti-bacterial treatment for cuts; scalp treatments; hair coloring; painting; applications of wood stain; dispensing glue; applying of shoe polish; decorating a cake; or applying mascara or other make-up.

The applicator device disclosed herein uses a valve system in a special applicator head for airless delivery of product, which in combination with a self-sealing cap, serves to provide multiple levels of protection of the integrity of the product contained therein.

OBJECTS OF THE INVENTION

It is an object of the invention to provide an airless means for delivering liquids, creams, gels and the like.

It is another object of the invention to provide a means for carefully controlling quantities of liquid or viscous semi-solid products dispensed onto a receiving surface.

It is a further object of the invention to provide a means of delivering measured quantities of liquid or viscous semi-solid product onto discrete surfaces of an object.

It is another object of the invention to provide a means that is adaptable to delivering liquid or viscous semi-solid product onto discrete surfaces encompassing either a small or large surface area.

It is also an object of the invention to provide a valve system and a spring biased dual cap to better preserve product integrity It is also an object of the invention to provide a means that is adaptable to effectively delivering either a low viscosity or high viscosity product.

Further objects and advantages of the invention will become apparent from the following description and claims, and from the accompanying drawings

SUMMARY OF THE INVENTION

An applicator device is comprised of an applicator head and a body. The invention disclosed herein provides for various embodiments of the applicator head, which may be secured within a portion of the body and provide for dispensing of measured amounts of product to be delivered onto discrete surfaces of an object. Although the applicator device may find use in various different applications, its functionality is particularly well suited for use in the cosmetics industry as a mascara applicator, for one embodiment, for eyeliner in another embodiment, etc.

The body may generally be comprised of a handle coupled to a piston rod which mates with a piston that is disposed within a cylinder. Installation of the applicator head into an end of the cylinder creates a chamber to serve as a product reservoir. The applicator head may be secured within the cylinder of the body, which may be accommodated by having one or more annular protrusions on the tubular extension of the applicator head, and corresponding annular indentations on the cylinder's mating internal surface.

The cylinder head may contain a valve arrangement to permit flow of product from the product reservoir into a valve cylinder product pool, but prevent backflow which could cause contamination of the product supply. Additionally, flow of product from the valve cylinder product pool to a product dispensing chamber is limited by a narrow opening therebetween to reduce eddies and possible back-flow to prevent the possibility of any contamination that may be present within the product dispensing chamber from entering the valve cylinder product pool. The entry of contaminants into the product dispensing chamber may also be limited through the use of a dual inner/outer cap, where the inner cap may be spring biased relative to the outer cap, which is secured to the body. The spring biased inner cap also serves to prevent essential oils and moisture from escaping from the product dispensing chamber.

BRIEF DESCRIPTION OF THE DRAWINGS

FIGS. 15A-18A is the cosmetic applicators of FIGS. 15-18, but with a second embodiment of a cap installed upon each applicator.

DETAILED DESCRIPTION OF THE INVENTION

Figure 1:
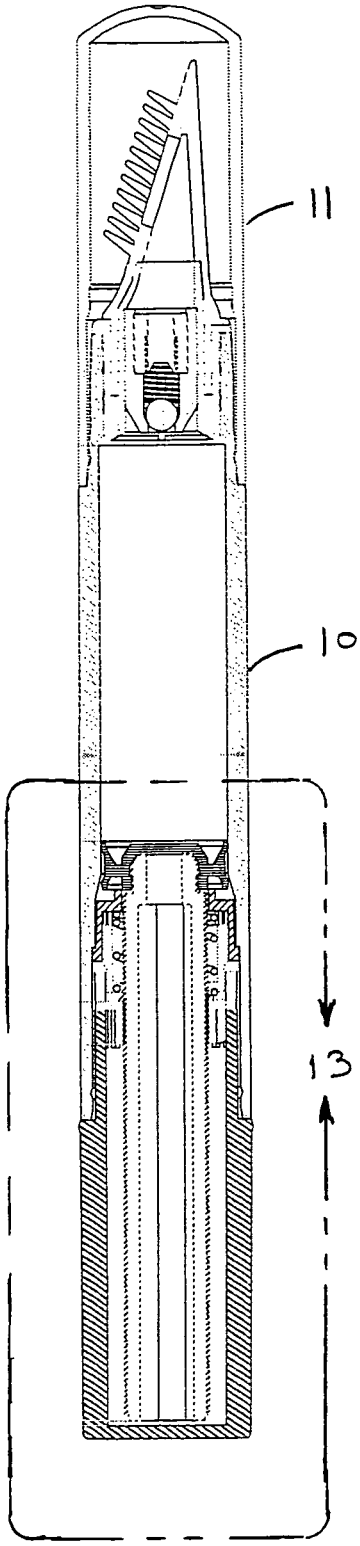
FIG. 1 is a cross-sectional view of a first embodiment of the applicator and cap of the present invention.
Figure 3:
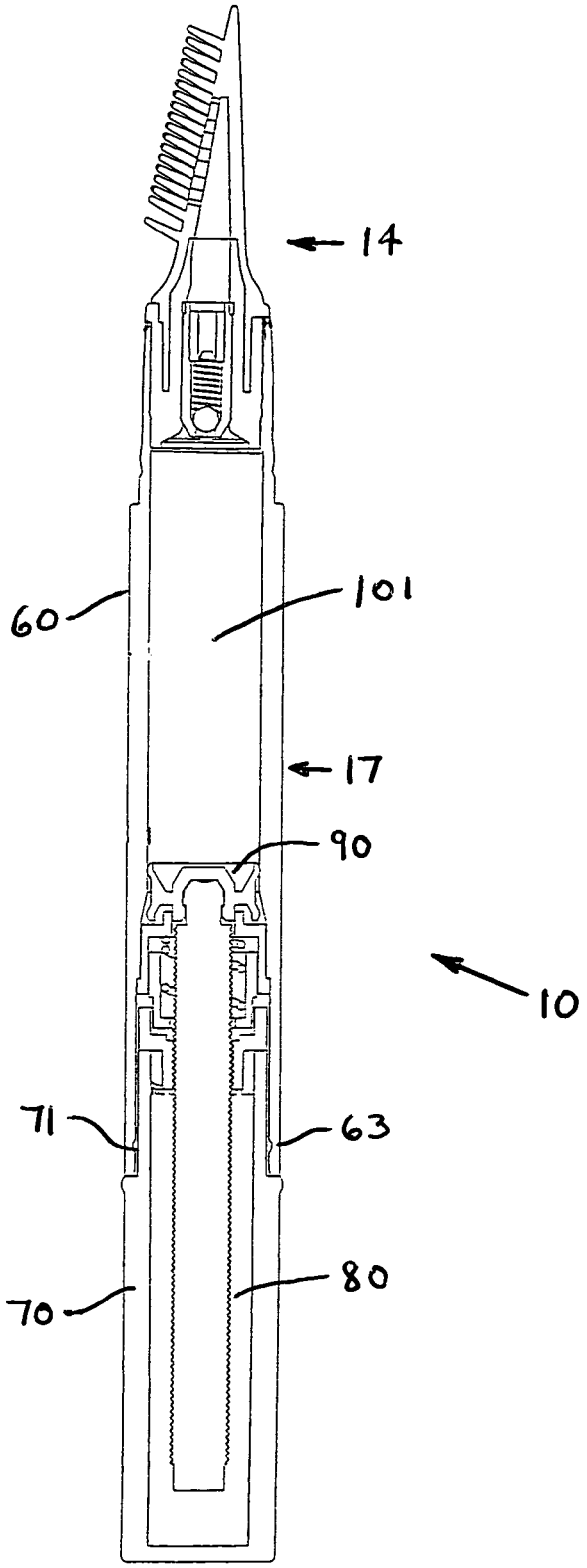
FIG. 3 is a side view of the first embodiment of the applicator of the present invention.
Figure 4:
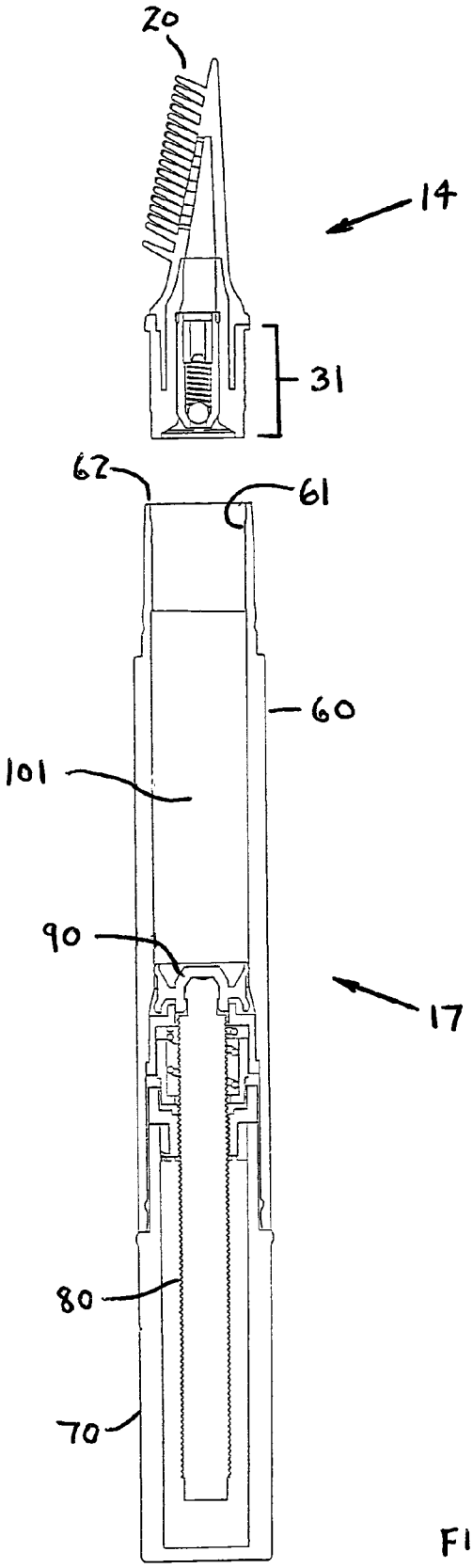
FIG. 4 is an exploded view of the applicator head and body of the first embodiment of the present invention.

FIG. 1 shows a first embodiment of the present invention, which includes an applicator device 10 with a cap 11. Assembly of the applicator device 10 is shown in the cross-sectional view of FIG. 3, and is broken down into its component parts—a body 17 and an applicator head 14—as seen in FIG. 4. The invention disclosed herein provides for various embodiments of the applicator head that may assemble into the body 17 in one of several ways to provide for careful dispensing of amounts of product to be delivered onto discrete surfaces of an object, or to provide for more generous delivery of a product onto a receiving surface, but while still be permitting deliberation with respect to where the product is applied. The invention also includes multiple product pooling areas to resist the spread of contaminants into the primary product pool, as well as a spring-biased dual cap that also serves to prevent the entry therein of contaminants, when secured onto the applicator, as well as serving to prevent the loss of essential moisture and oils from the product.

The body 17 (FIGS. 3 and 4) may generally be comprised of cylinder 60 that rotatably receives a handle 70 so that the handle is free to rotate relative to the cylinder. As seen in FIG. 3, a cylindrical portion of the handle 70 may be received within cylinder 60 and thereby be able to rotate, and may be retained therein by use of an annular protrusion 71 on the handle 70 being received by an annular recess 63 on the cylinder 60. The handle 70 may be threadably coupled to a piston rod 80, so that rotation of the handle causes the piston rod to advance within the cylinder 60. The piston rod 80 may engage and drive a piston 90, which may be slidably disposed within the cylinder, to advance the piston therein. Installation of applicator head 14 into body 17 forms a product reservoir 101, between the piston 90 and generally the end or bottom of the head 40, and advancement of the piston may cause the enclosed volume of the reservoir to decrease, forcing product to be pumped therefrom.

Figure 6:
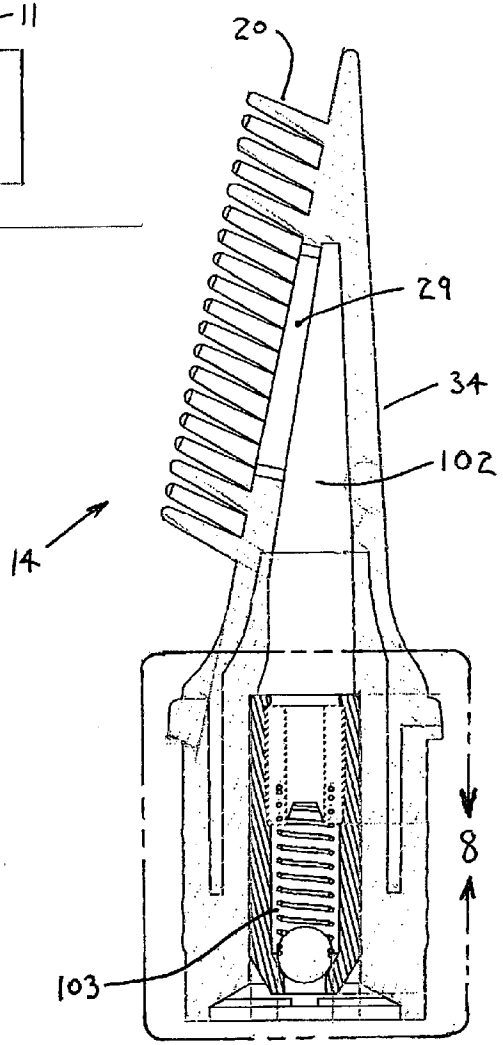
FIG. 6 is a cross-sectional view of the applicator head of FIG. 5.

The applicator head 14 may be installed into the body 17 through one of several different mechanical means. In one embodiment, the applicator head 14 may be installed into, and retained within, body 17 by use of a friction fit. In another embodiment, the applicator head 14 may be threadably installed into body 17 by use of internal threading on the cylinder's upper internal surface 61, and use of external threading on the tubular extension 31 of the applicator head 14. In yet another embodiment, shown in FIGS. 5 and 6, the applicator head 14 may be snapped into cylinder 60 of the body 17. The snap-in arrangement may be accommodated by having one or more annular protrusions 32 on the tubular extension 31 of the applicator head 14, and corresponding annular indentations or recesses on the cylinder's upper internal surface 61. Alternatively, the indentations may be formed on the applicator head 14, while the annular protrusions are formed on the cylinder's upper internal surface 61. Any of these installation means for the applicator head 14 may be adapted to permit removal of the head and allow interchangeability of one applicator head in favor of another applicator head. Alternatively, the applicator head 14 may be securely and permanently attached to the body 17, which may better act to preserve the integrity of the product contained therein, by reducing or eliminating the possibility of contaminants being introduced into the product supply, and by better serving to retain moisture and essential oils therein.

Figure 8:
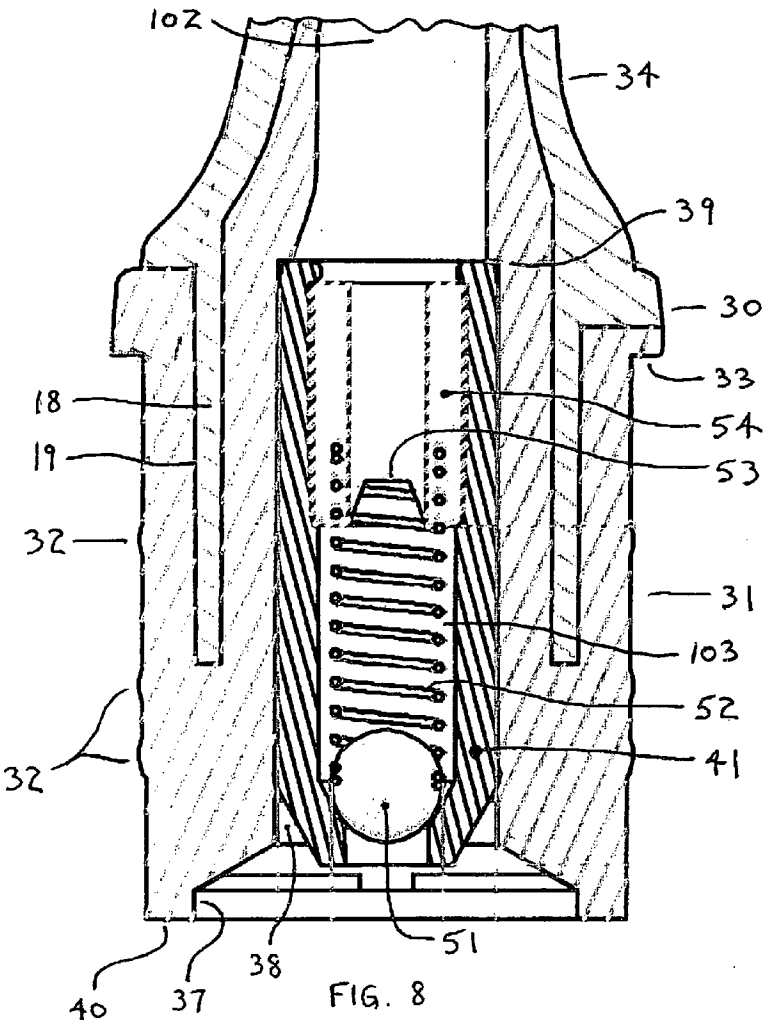
FIG. 8 is the cross-sectional view of FIG. 7, being enlarged to show the valve portion details.
Figure 12:
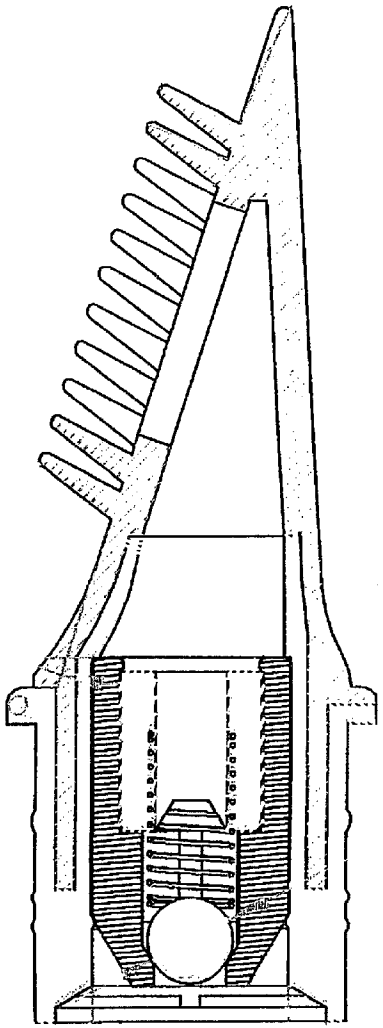
FIG. 12 is a cross-sectional view of the second embodiment of the applicator head of the present invention.

The applicator head 14 of the current invention may comprise a tubular extension 31 originating from an annular pedestal 30 (FIG. 8). The pedestal 30 may overhang the tubular extension 31 so as to form a shoulder 33. Installation of the applicator head 14 may occur with the tubular extension 31 being mated with the cylinder's upper internal surface 61 (FIG. 4) until shoulder 33 of the applicator head 14 reaches the end wall 62 of cylinder 60. An o-ring seal may be accommodated at the meeting of shoulder 33 and end wall 62 of cylinder 60, or may be accommodated where tubular extension 31 mates with the cylinder's upper internal surface 61.

Extending upward from pedestal 30 may be a V-shaped neck 34. The V-shaped neck 34 and tubular extension 31 may be formed as a single housing, or may be separately formed and then be mated together using male and female connectors 18 and 19 on respective parts (FIG. 8). Pedestal 30 may be integral to either the V-shaped neck 34 of tubular extension 31. The tubular extension 31 may include a cylindrical opening 38 beginning on the bottom surface 40—a first end of the housing—and may interconnect with an opening at a second end of the housing to form a conduit. Where the cylindrical opening 38 begins on surface 40, there may also be a countersunk opening 37 to transition between the cylindrical opening 38 and the flat surface 40.

Figure 9:
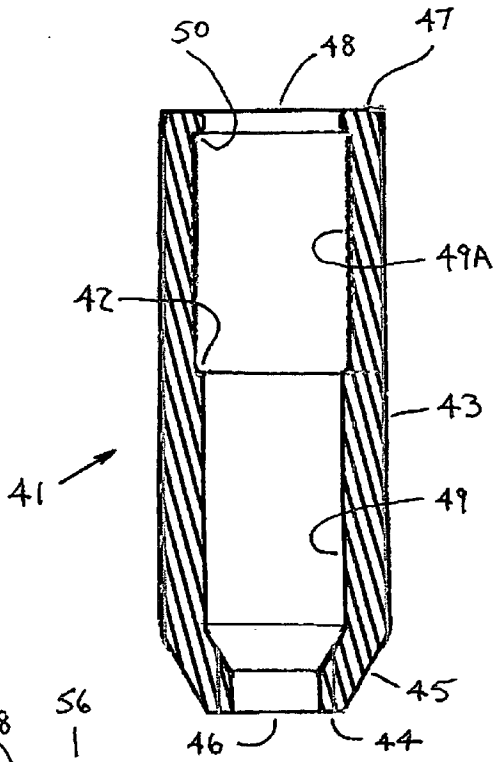
FIG. 9 is an enlarged cross-sectional view of the valve cylinder of the first embodiment of the applicator head of the present invention.
Figure 10:
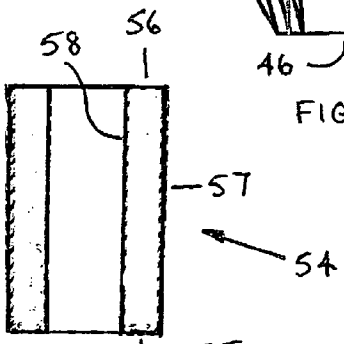
FIG. 10 is an enlarged cross-sectional view of the cylinder member of the first embodiment of the applicator head of the present invention.

Inserted into cylindrical opening 38 to occupy at least a portion of the conduit may be a valve cylinder 41. The portion of the conduit beyond the valve cylinder may comprise a product dispensing chamber 102. Where the cylindrical opening 38 transitions into the product dispensing chamber 102, within the V-shaped neck 34, a lip 39 may be formed to retain the valve cylinder. Valve cylinder 41 being installed therein may generally comprise a cylindrical outer wall 43 having a first end 44 and a second end 47 (FIG. 9). The first end 44 may have a tapered surface 45 between the cylindrical outer wall 43 and the first end 44. The first end may also have an opening 46 into an inner wall 49, which may be parallel to the outer wall 43 and taper 45. The inner wall 49 may transition to a second inner wall 49A having a greater diameter than inner wall 49, and create a first lip 42. An opening 48 in the second end 47 may create a second lip 50 at the second end 47 of the valve cylinder 41.

The valve cylinder 41 may be inserted into the cylindrical opening 38 of tubular extension 31 as seen in FIG. 8, which may interconnect to at least one opening at a second end of the housing to form a conduit. The first end 48 of the valve cylinder 41 may be flush with the end 39 of cylindrical opening 38. The external diameter of outer wall 43 and the internal diameter of cylindrical opening 38 may be sized so as to be engaged in an interference fit (friction fit) rather than a clearance fit, whereby the valve cylinder 41 may be inserted through either a press-fit installation process or a cryogenic installation process. The interference fit would serve to positively retain the valve cylinder 41 within the cylindrical opening 38.

Within the valve cylinder 41 may be cylindrical member 54, having a first end 55, a second end 56, an outer wall 57, and an inner wall 58. The cylindrical member 54 may be positioned within the valve cylinder 41 between the first lip 42 and second lip 50. A blocking member, which may for example be a cylindrical piston, is preferably a spherical valve ball 51 being disposed within the valve cylinder 41, as seen in FIG. 8, and may be biased by a helical compression spring 52 to normally block the opening 46 of the valve cylinder 41. The ball 51 may selectively block or close off the flow of product through the valve cylinder 41, so that valve cylinder product pool 103 may operate as an intermediate pooling area, to serve in maintaining product integrity within the reservoir 101. The valve cylinder product pool 103, being formed by the spherical ball on one end, and the shoulder 50 of valve cylinder 41 on the other end, in conjunction with the selective blocking of the valve cylinder, serves to reduce or eliminate the possibility of such contamination.

By twisting the handle 70, the mechanical connection with the piston rod 80 drives the piston 90, which in turn forces product contained within the product reservoir 101 against the spherical ball 51 to counter the biasing provided by spring 52. The product may then flow past the spherical ball 51 into the valve cylinder product pool 103. The valve arrangement serves to isolate the product within the product reservoir 101 and maintain its integrity, so there can be no back-flow of product which could cause contamination by matter acquired from the receiving surface. Moreover, the valve arrangement and dual reservoir arrangement of the head (product dispensing chamber 102 and valve cylinder product pool 103) also serves as a barrier to keep air from entering the chamber, and thus serves to maintain product moisture and consistency, and eliminate any entry of air-borne contamination in the form of dust, pet dander, mold, pollen, bacteria, etc. It should be noted that the isolation provided between the product dispensing chamber 102 and valve cylinder product pool 103 may be increased by significantly reducing the size of the opening 48 in the second end 47 of valve cylinder 41. The size need only be large enough to permit passage therethrough of the cosmetic product, and where the cosmetic product is less viscous, the size may be reduced even further.

Figure 7:
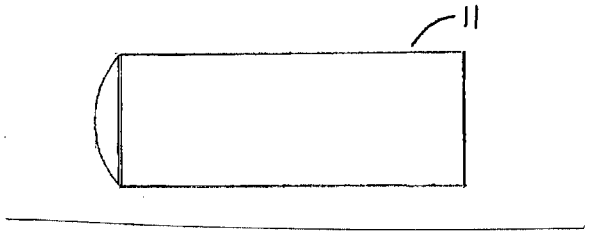
FIG. 7 is a side view of the cap of the first embodiment of the applicator of the present invention.

The V-shaped neck 34 may have a flat face 36 (a second end of the housing) that terminates in a tip 35. Protruding from the flat face 36 may be a plurality of prongs 20. In a first embodiment, the prongs may comprise a conical outer surface 21 which, as seen in FIG. 7, may protrude outward from the flat face 36 to end in a curved tip 24. The prongs may be manufactured from any suitable material. Material selection may be dictated by the particular application. Where the applicator may be used to dispense make-up products such as mascara, the nozzle may be made from materials including, but not limited to a thermo plastic elastomer (TPE). With the prongs so constructed, product may be dispensed with a careful turn of the handle 70. The threading on the handle 70 and on the piston rod 80 may be of such a pitch and coarseness/fineness to produce the appropriate degree of movement of the piston, to result in a desired amount of product delivery, which may depend upon the viscosity of the product being dispensed.

Figure 5:
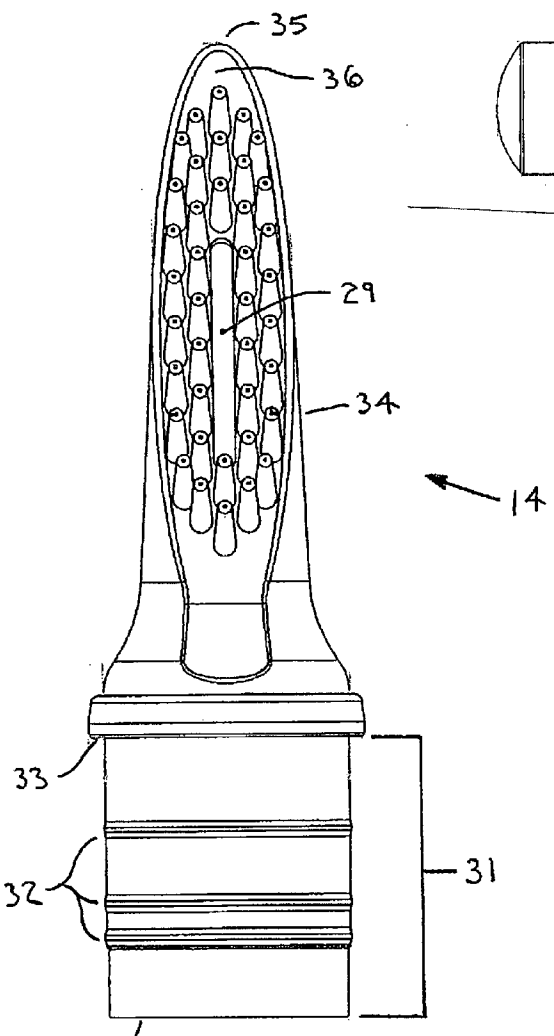
FIG. 5 is a front view of one embodiment of the applicator head of the present invention.
Figure 6A:
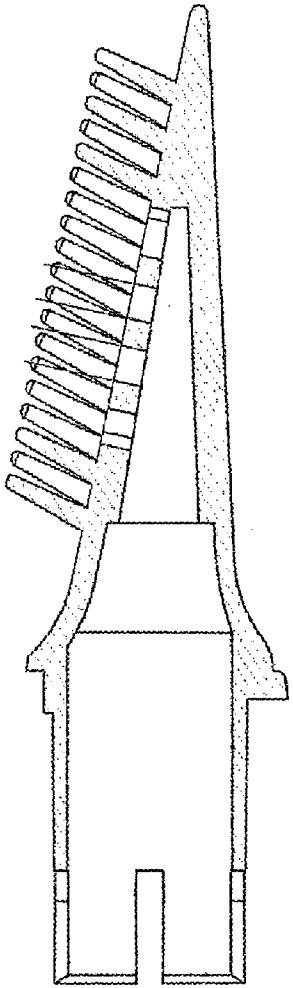
FIG. 6A is a cross-sectional view of the alternate embodiment in FIG. 6.
Figure 5A:
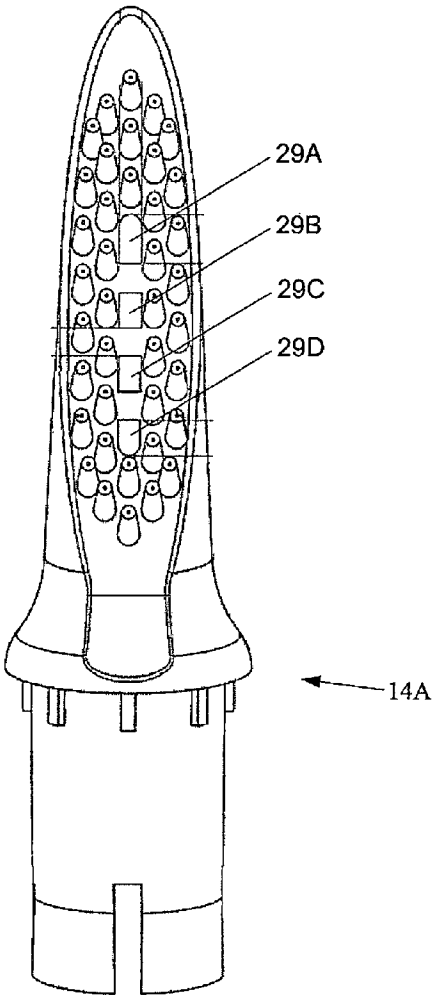
FIG. 5A is a front view of an alternate embodiment of the applicator head.
Figure 11:
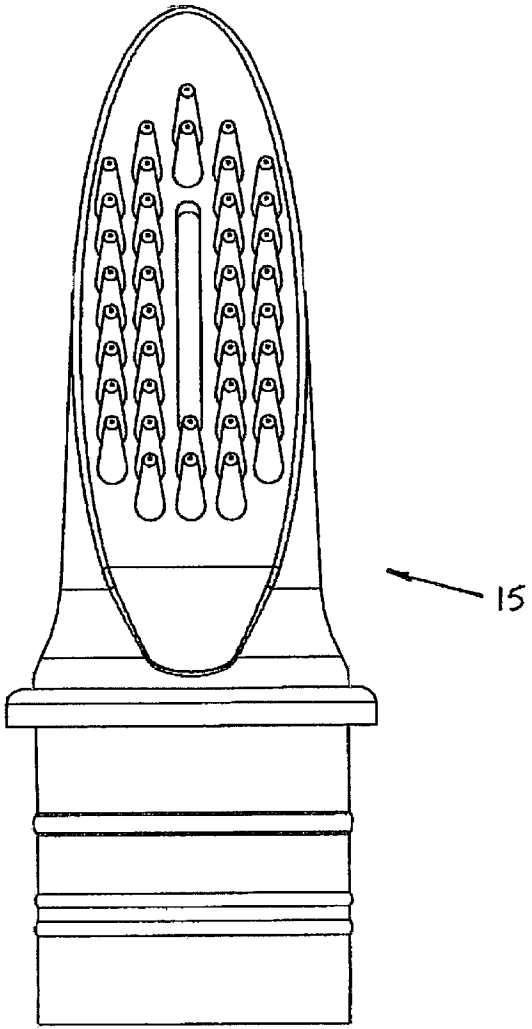
FIG. 11 is a front view of a second embodiment of the applicator head of the present invention.
Figure 13:
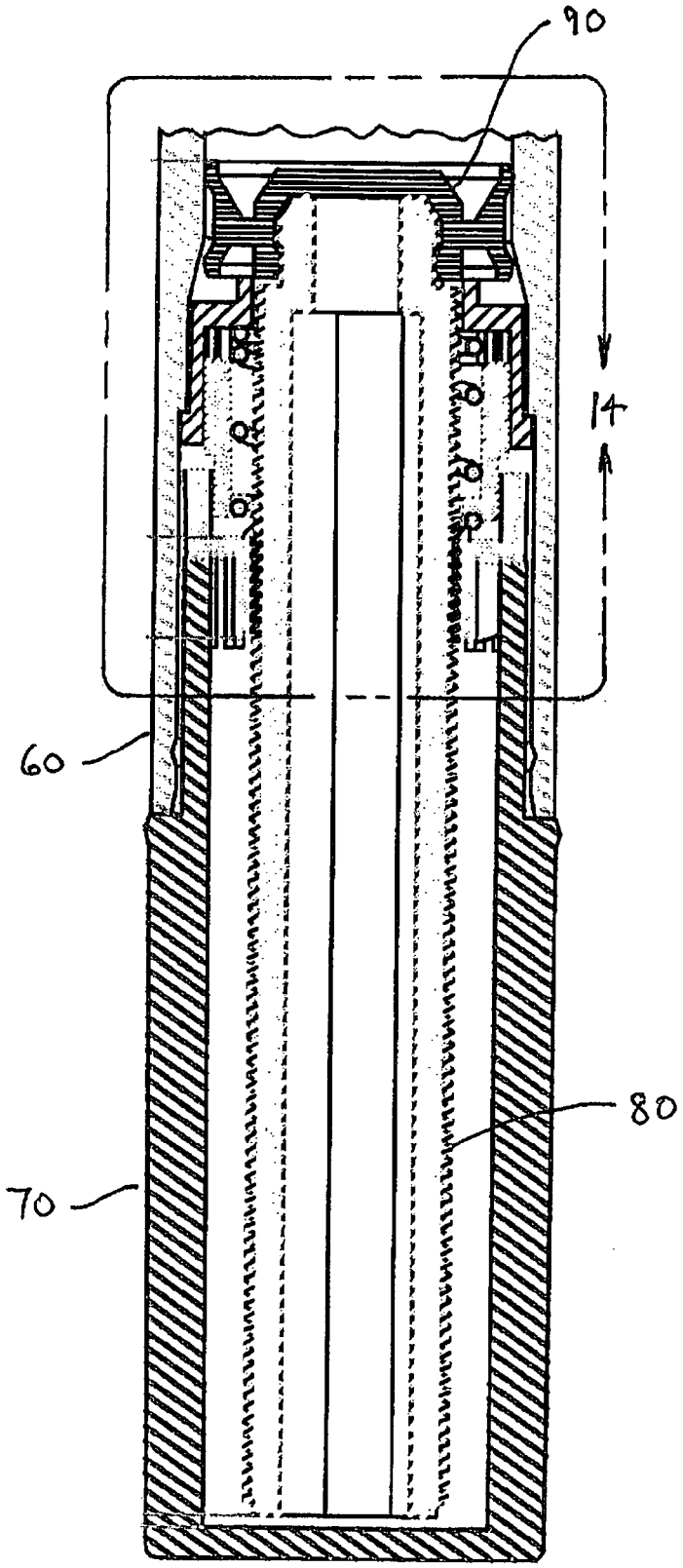
FIG. 13 is an enlarged cross-sectional view of the base portion of a first embodiment of the applicator of the present invention.
Figure 14:
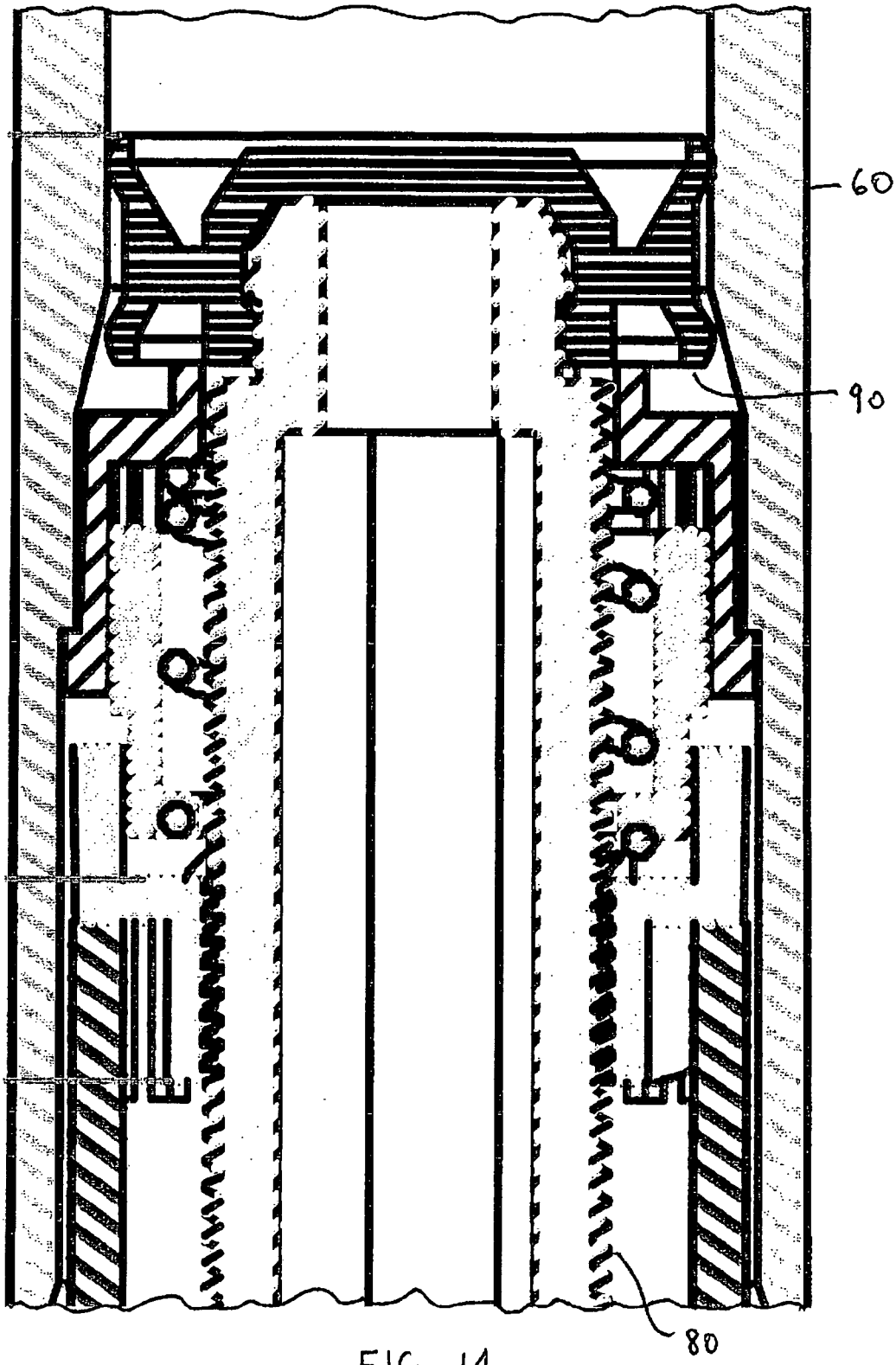
FIG. 14 is an enlarged cross-sectional view of the adjustment portion of the base of a first embodiment of the applicator of the present invention.
Figure 15:
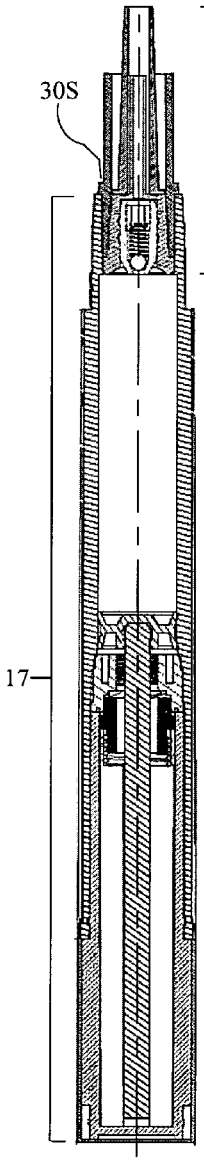
FIG. 15 is a side view of a first alternate embodiment of an applicator head of the present invention, for product delivery without need of a pronged applicator.
Figure 16:
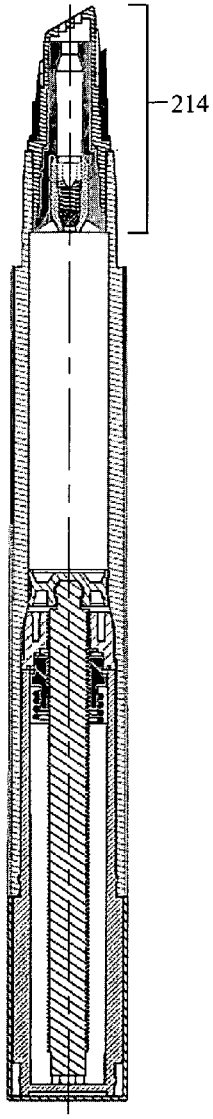
FIG. 16 is a side view of a second alternate embodiment of an applicator head of the present invention, for product delivery without need of a pronged applicator.

As seen in FIGS. 5 and 11, the conical prongs 20 may surround a single elongated opening 29 in the flat face 36, or alternatively, the prongs may surround a plurality of smaller openings, such as the openings 29A, 29B, 29C, and 29D that may be seen in FIG. 5A for head 14A. The elongated opening 29 or openings 29A-29D may directly interconnect to the dispensing chamber 102, which may interconnect with the valve cylinder product pool 103 that may further isolate the product contained therein by increasing the overhang provided by shoulder 50 so that opening 48 is reduced in size to tend to prohibit product from re-circulating back through the opening. The length and width of each of the one or more openings 29 or openings 29A, 29B, 29C, and 29D may vary to produce a smaller or larger opening surface area depending upon the type of product being dispensed, and its particular viscosity, as well as a desired flow rate. The shape of the openings also need not be rectangular to be characterized by length and width, and may instead be circular, elliptical, or some other shape, even being an irregular shape. Also, the total number of prongs may vary, and may be adjusted for a particular application, as well as their location relative to the opening, and the density of prongs for a given area on the flat face 36 may also vary for a particular application, as seen in the applicator head 15 in FIG. 11.

Figure 2:
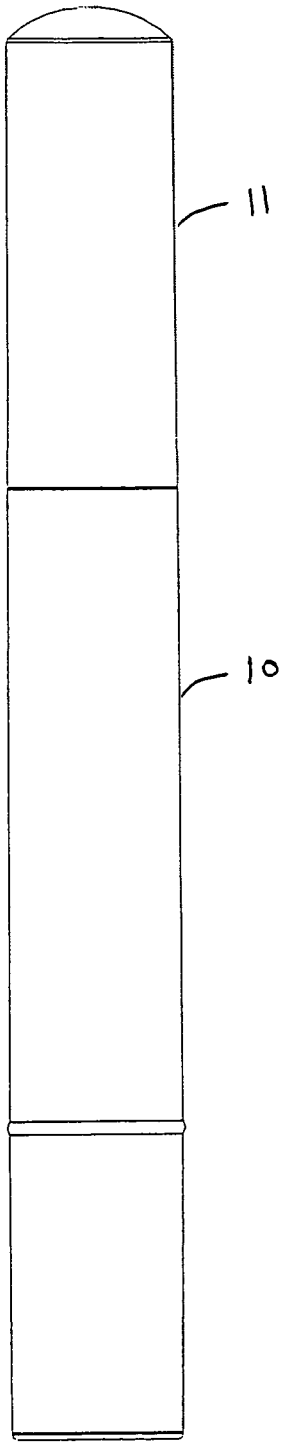
FIG. 2 is a side view of the first embodiment of FIG. 1.
Figure 2A:
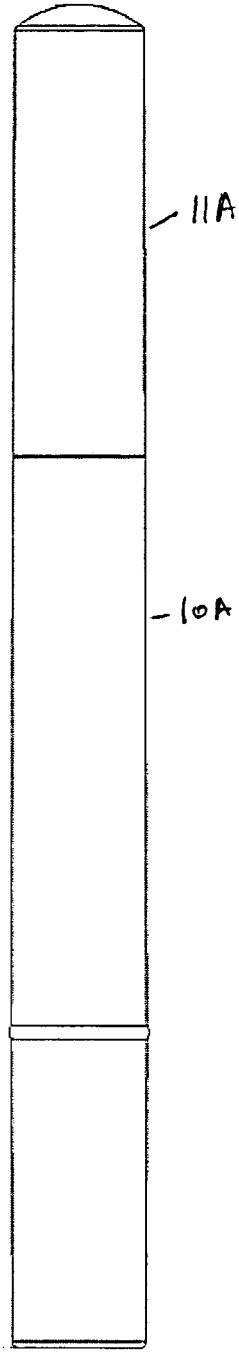
FIG. 2A is a side view of the alternate embodiment of FIG. 2A.
Figure 2B:
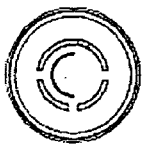
FIG. 2B is a bottom view of the embodiment of FIG. 2A.

As seen in FIGS. 1-2, a cap 11 may be snapped onto the applicator head to protect product contained within the product dispensing chamber applicator against contamination. The snapping of the cap may be through the use of any of the mechanical attachment means discussed previously—receiving the cap onto the head in a friction fit; or snapping the cap onto the head using an annular protrusion being received in an annular recess; or a threaded connection. Additionally, as seen in FIGS. 1A-2A, a cap 11A may be threadably received onto the applicator head, to provide an air-tight seal. Also, the caps 11 or 11A may comprise an insert, where the insert serves to wipe the prongs during placement and/or removal of the cap from said applicator head.

Figure 1A:
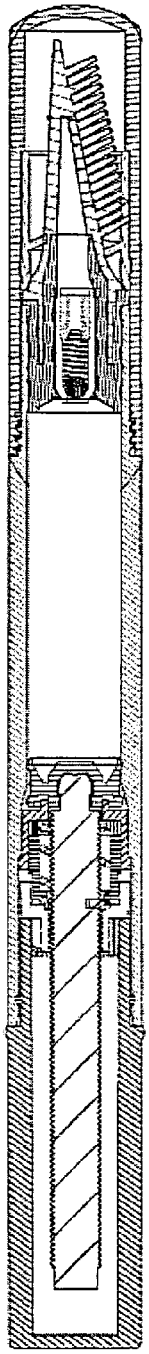
FIG. 1A is a cross-sectional view of an alternate embodiment of the applicator and cap of the present invention.
Figure 1B:
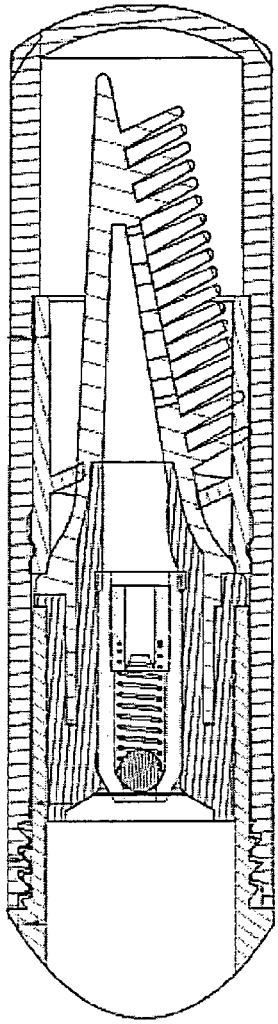
FIG. 1B is the view of FIG. 1A enlarged to show details of the wipe and cap threading.
Figure 1C:
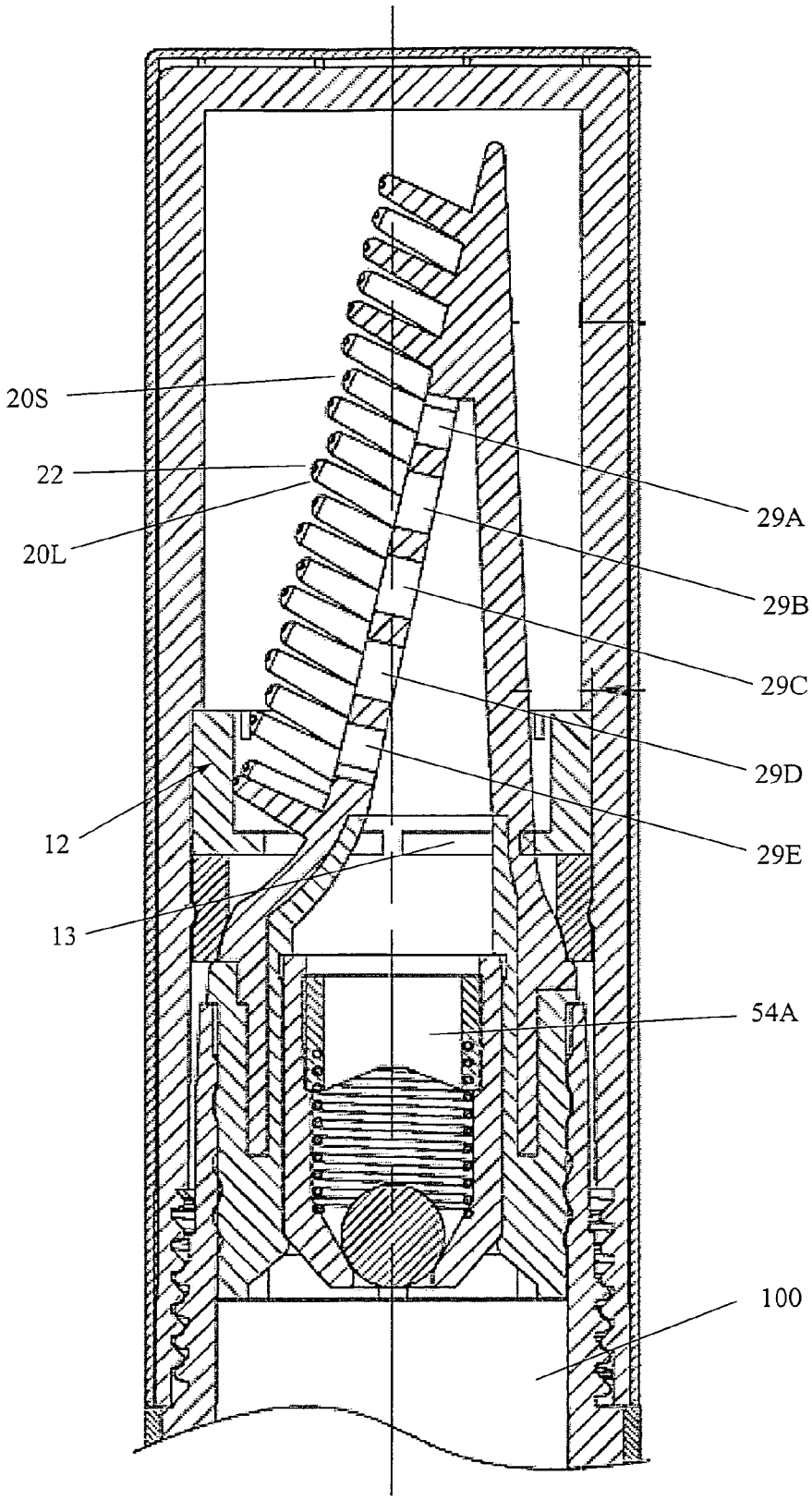
FIG. 1C is an alternate embodiment of the head and cap of FIG. 1B.

In yet another embodiment, seen in FIG. 1C, there may preferably be an alternating series of longer and shorter prongs, 20L and 20S, that extend away from the flat surface 36, and which serve to aid a user in applying the mascara, by permitting the longer prongs to initially contact and deflect a portion of the user's lashes, while the adjacent shorter prongs 20S follow and serve to better apply mascara to the inside surfaces of the exposed lashes, which may be a portion of the lash that is generally more difficult to reach. The difference in height of the prongs may preferably be at least 0.030 inches to permit the longer prongs to contact one or more lashes and cause deflection before the shorter prongs contact the undeflected lashes. The height difference may preferably be not much more than 0.060 inches, otherwise the amount of displacement of the longer prongs 20L may be such that some of the deflected lashes may spring back to their initial position. There may be at least a single row of the alternating series of prongs disposed about each side of a plurality of openings 29A-29E (in the case of five openings, as seen in FIG. 1C), or there may be, as seen in FIG. 5A, two or more rows of prongs disposed about each side of the plurality of openings. A long prong 20L may also be disposed between openings 29A and 29B, between 29B and 29C, and between openings 29C and 29D. Also in this embodiment, a screw-on cap may also be used, and which contains an insert 12 that may be made of a flexible material that has a flange 13 that extends at least part-way across the opening of the cap, and thereby serves to wipe the prongs, during placement on and/or removal of the cap from, the applicator head. This prevents agglomeration and drying of mascara product upon the prongs, which would tend to degrade the fidelity with which the applicator may be used to apply mascara onto a person's lashes. While any excess product transferred to the insert may agglomerate thereon, such agglomeration would not serve to degrade application of product onto the user.

Figure 15A:
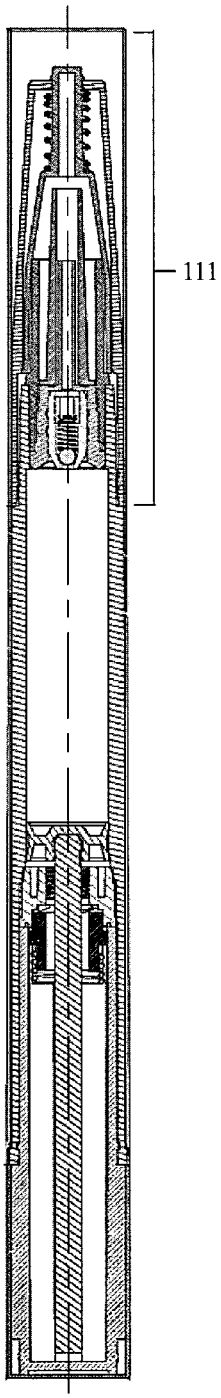
Figure 17A:
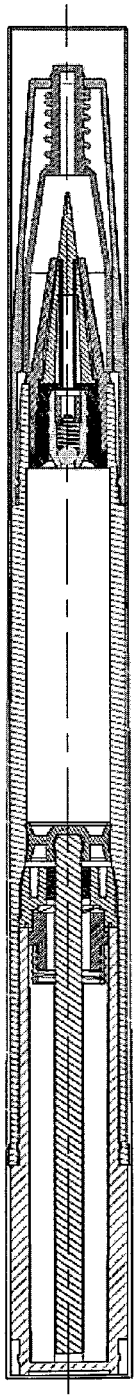
Figure 18A:
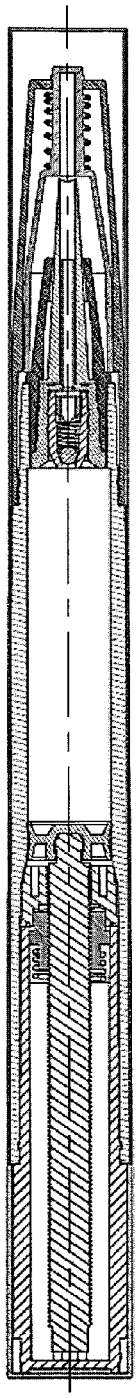
Figure 15B:
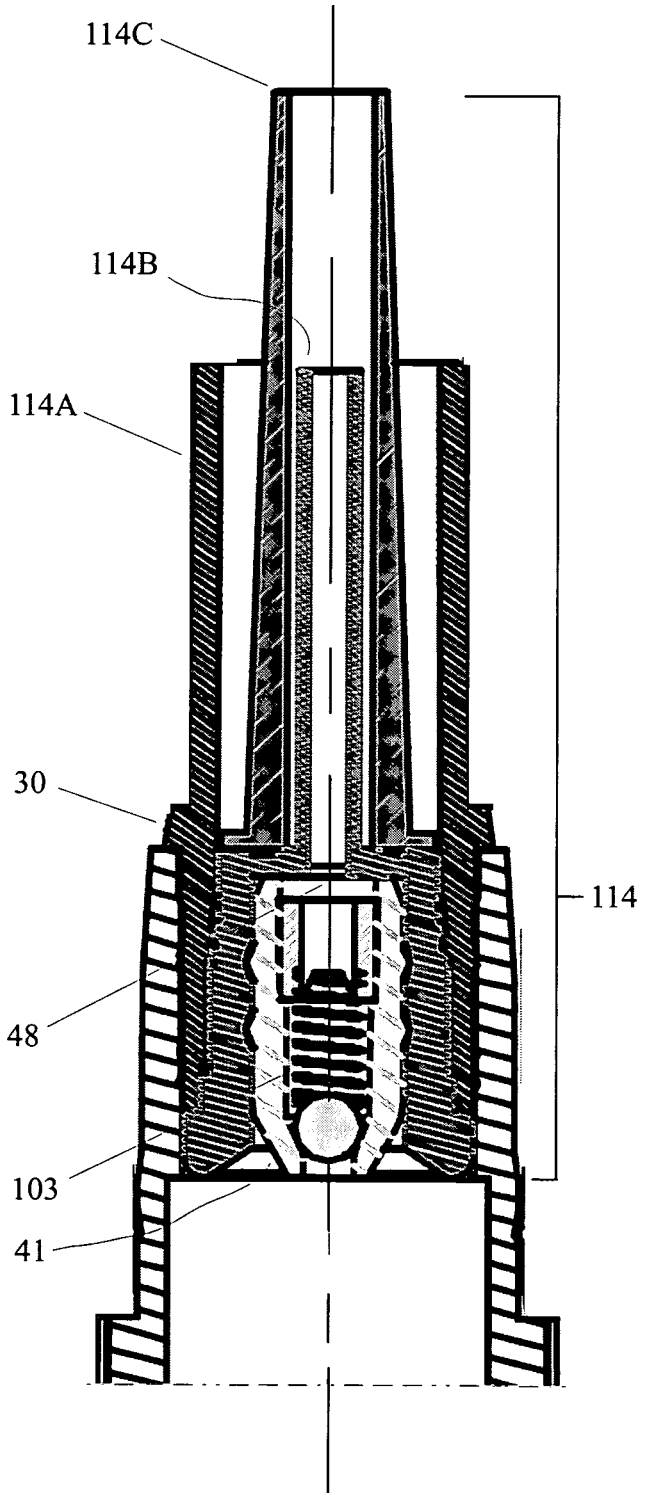
FIG. 15B is an enlarged view of the applicator head of FIG. 15.

As seen in FIGS. 15-18, other embodiments of the head may be used, and may be specifically tailored for the application of different cosmetic products and other types of products, and may be used for the application of oral products (e.g., teeth whitener), eye products (e.g., eye shadow, eye liner), lip products, nail products, etc. The applicator head 114 is shown enlarged in FIG. 15A and may comprise, instead of the V-shaped neck 34, a hollow outer cylinder 114A that extends from the annular pedestal 30 to serve as a protective housing. A hollow inner cylinder 114B may extend to be concentric with the opening 48 in the second end of valve cylinder 41, and may serve to conduct product away from the valve cylinder product pool 103. A hollow cylinder 114C may be larger than and concentric with the inner cylinder 114B, and may extend further than cylinder 114B, to serve in the application of the product.

Figure 16A:
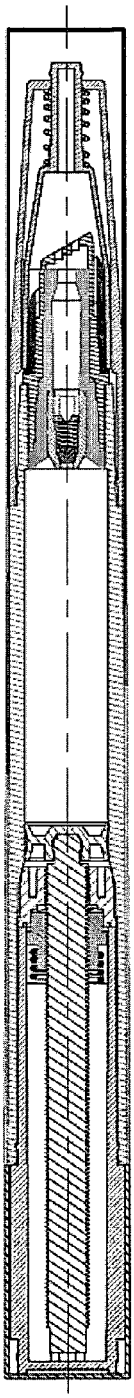
FIG. 16B is an enlarged view of the applicator head of FIG. 16.
Figure 16B:
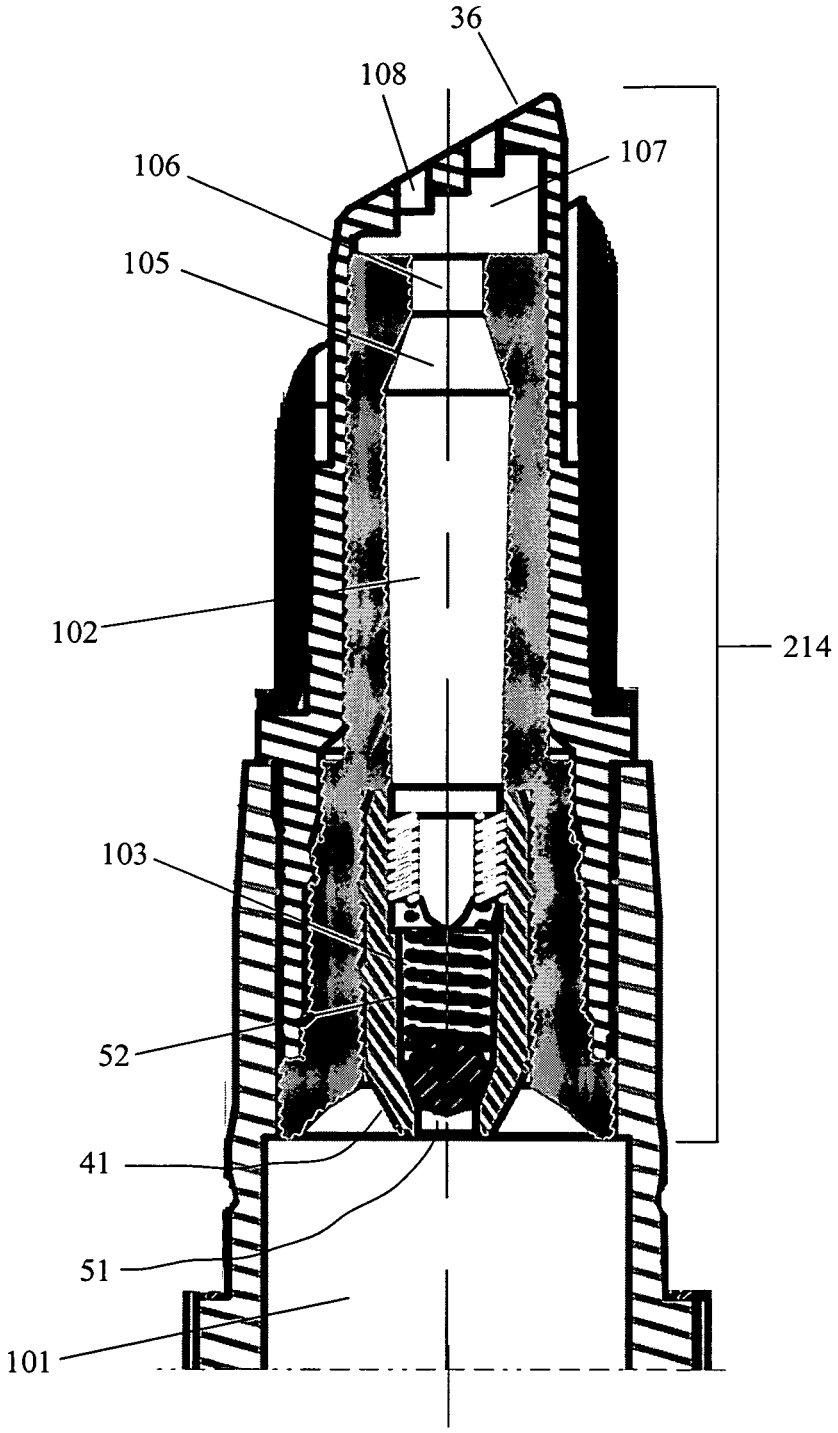

The applicator head 214, which is shown enlarged in FIG. 16B, may similarly be installed into the body 17, but may have an application member being particularly constructed for applications requiring or preferring use of a generally flat dispensing surface to apply the products. The applicator head 214 may comprise the same valve components as the applicator head 14, including the valve cylinder 41, spherical valve ball 51, helical compression spring 52, etc. However, the product dispensing chamber 102 may be generally cylindrical, and may have a tapered region 105 into a neck region 106, that may open into a dispensing surface supply pool 107. The second end of the head may also have a generally flat face 36, which may serve in the application of the lip product. The flat surface 36 may have one or more small openings 108 that interconnect with the dispensing surface supply pool 107. By twisting the handle 70, lip product may pass from the reservoir 101, past the spherical valve ball 52, through the valve cylinder 41, and through the product dispensing chamber 102 and dispensing surface supply pool 107 to be deposited out from a plurality of openings 108 onto the flat surface 36 for application onto a user's lips. The plurality of openings 108 may be distributed evenly about the flat surface 36. In a variation of this embodiment, the exposed portion of the applicator head 214 may comprise a felt surface, or at least the flat surface 36 may comprise a felt surface for an even and streak-free application of product.

Figure 17:
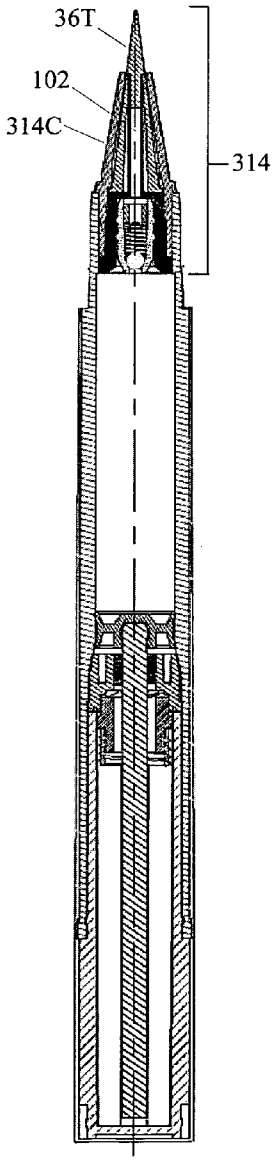
FIG. 17 is a side view of a third alternate embodiment of an applicator head of the present invention, for product delivery without need of a pronged applicator.
Figure 18:
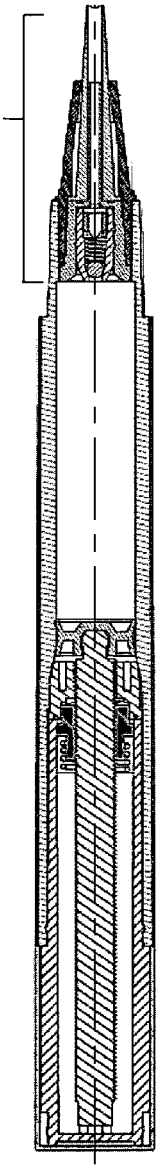
FIG. 18 is a side view of a fourth alternate embodiment of an applicator head of the present invention, for product delivery without need of a pronged applicator.

A different arrangement is offered by head 314, which is shown in FIG. 17, and which may be usable for applying cosmetic products along a narrow path, such as, for example, eyeliner. The head 314 may have a conical housing 314C, and instead of a flat application surface 36, it may also have a wedge-shaped, or conical application member 36T. The tapered application member 36T may be disposed directly over the product dispensing chamber 102 so as to block the free flow of product therefrom. However, the material of the tapered application member 36T may comprise properties such that it may be capable of being permeated by the product, which may be a liquid or a semi-liquid, to supply the tip with product for application in a desired location. The material of the tapered application member 36T may comprise felt.

Figure 20:
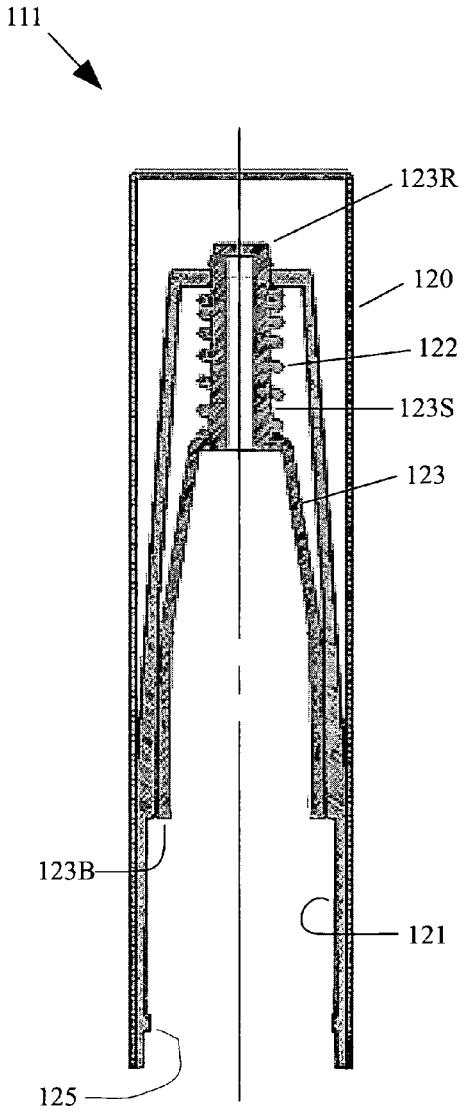
FIG. 20 is an enlarged view of the second cap embodiment of FIGS. 15A-18A.

FIGS. 15A, 16A, 17A, and 18A also show another cap embodiment 111 being secured upon each of the applicator heads that were shown in FIGS. 15-18. Cap 111, which is shown by itself and enlarged in FIG. 20, may comprise an outer cap member 120, an inner cap support member 121, a helical spring 122, and an inner cap 123. The outer cap member 120 may receive an assembly of the other cap components as follows. The inner cap member 123 may comprise a shaft portion 123S, at the end of which may be a stop in the form of an integral retaining head 123R. The helical spring 122 may be slid onto the shaft portion 123S of the inner cap 123, after which the shaft portion 123S may be inserted through a hole in the inner cap support member 121, by press/shrink fit installing the integral retaining head 123R through the hole, as the integral retaining head may be hat-shaped to prevent its returning back through the hole. That assembly of cap components may then be installed within the outer cap member 120, and be secured therein using any suitable means known in the art, including, but not limited to, using adhesive, and/or mechanical fasteners such as rivets, screws, etc. Also, it may be recognized that the outer cap member 120 and the inner cap support member 121 may be formed as a single part, particularly where it is made using a plastic injection molding process or as a cast part. The inner cap 121, when being secured upon one of the applicator heads seen in FIGS. 15-18, may thus have a bottom surface 123B be spring biased into contact with a sill portion 30S of the annular pedestal 30. The cap 111 may be secured to the applicator by a securing means 125 that may include threadably receiving the cap onto the applicator head, by the use of corresponding internal and external threading on the cap and applicator. Alternatively, the securing means may comprise receiving the cap onto the head in a friction fit; or snapping the cap onto the head using an annular protrusion or lip on one applicator part, and an annular recess on the corresponding applicator part.

Figure 19:
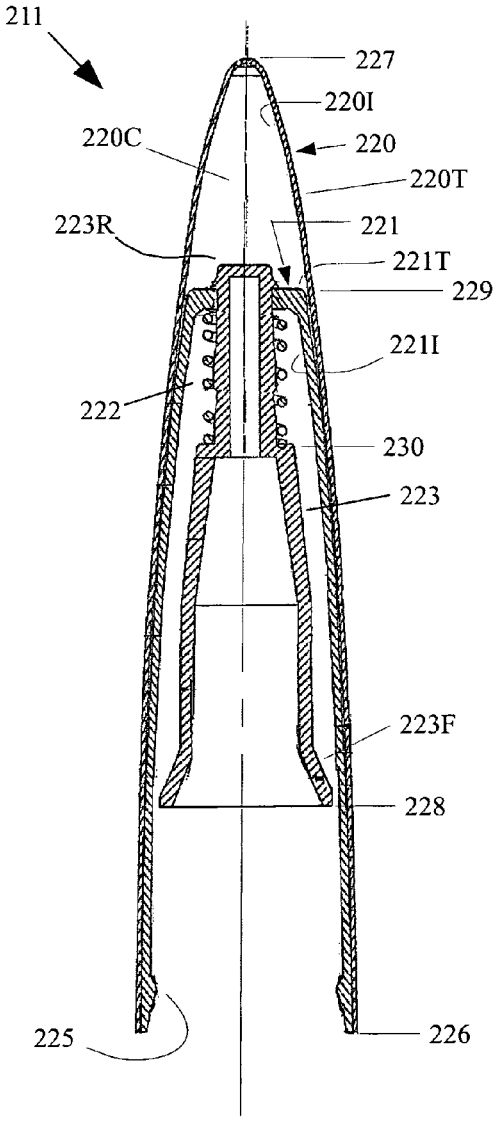
FIG. 19 is an enlarged view of a third embodiment of a cap of the present invention.

An alternate embodiment of cap 111 is shown by the illustration of cap 211 in FIG. 19. An outer cap 220 with outer surface 220T may be open at a first end 226 exposing an interior surface 220I, and may be closed at a second end 227.

The open first end 226 may receive the other components therein. The inner cap support member 221 with outer surface 221T may be open at a first end 226 exposing an interior surface 221I, and may be generally closed at a second end 229. The second end 229 of the inner cap support member 221 may be formed to have a flat wall with an orifice therein. The inner cap 223 may comprise a cap portion and a shaft portion. The cap portion may be open at a first end 228 and be generally closed at a second end 230. The shaft portion may have a first end being fixed to and extending out from the second end 230 of the cap portion, and the second end of the shaft portion may comprise a hat-shaped stop member, which may be integral, or may be mechanically attached onto the shaft (swaged, etc). With the helical spring 222 being received over the shaft portion of the inner cap 223, the combination spring and inner cap may be received through the open end 226 of the cap support member 221, with the shaft portion being slidable received through the orifice of the cap support member. The spring may thereby bear against the wall of the cap support member 221, and against the second end 230 of the cap portion of the inner cap 223. The stop 223R may thereafter serve to limit the outward biased travel of the inner cap 223 back towards the open end 226 of the cap support member. The cap support member 221 with the inner cap 223 and helical spring 222 assembled together, may then be received through the open end 226 of the outer cap 220.

The shape of the outer cap member 220 may comprise and elongated contoured cavity 220C, which may provide added space so that a force may counter the biasing of the spring to move the shaft portion of the inner cap, as described in the following sections, into the cavity. The shape of the inner cap 221 may also be contoured so as to have a flared section 223F proximate to first end 228, which may also have an annular protrusion or lip at a convex portion of the flared contouring (see FIG. 21).

Figure 22:
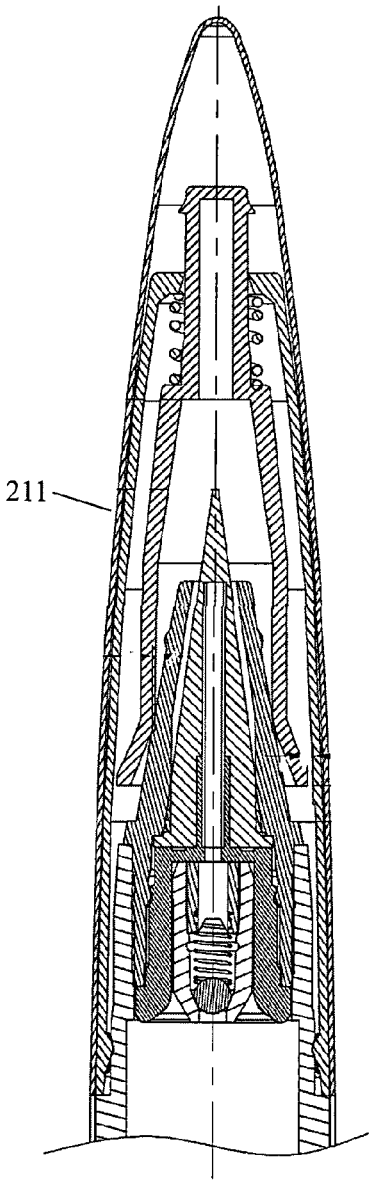
FIG. 22 is the cap of FIG. 19 after it has been installed upon an applicator head.
Figure 21:
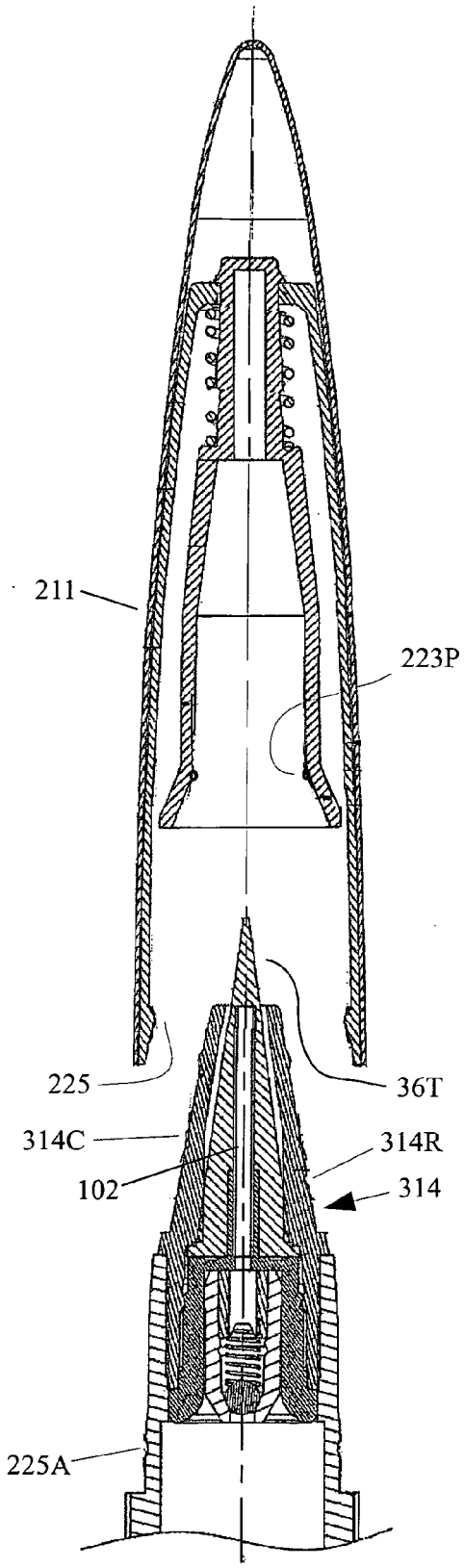
FIG. 21 is the cap of FIG. 19 as it is being installed upon an applicator head.

Installation of cap 211 may be upon an applicator head, as seen in FIGS. 21-22, where the applicator head housing may be conical such as for applicator head 314, and where the shape of the inner cap 223 may have corresponding contouring. As seen in FIG. 21, as the airtight sealing cap 211 is concentrically translated onto the applicator head 314, the convex surface of the inner cap member 223 at the flare 223F contacts a portion of the conical surface 314C of the applicator head 314, and the spring biases the inner cap member into airtight contact with the applicator head. The outer cap portion may continue its translation until a securing means 225 on the cap support member 221 is secured to a corresponding securing means 225A on the applicator head 314.

The helical spring 222 biasing the inner cap 223 into the tapered applicator head housing may cause slight elastic deformation of the annular periphery of the inner cap member, which may be manufactured in a thin enough section to accommodate such deformation by the spring 222. This may result in the applicator head better receiving the cap 211 in an air-tight seal, as the elastic deformation may serve to overcome any slight deviations due to manufacturing tolerances, etc., in either the shape of the cap or the applicator head, which may otherwise permit air passage therebetween. A small annular recess 314R may also be provided in the conical applicator head 314 for receiving a small corresponding annular protrusion 223P at the convex portion of the inner cap 223, which may also serve in the airtight sealing, by limiting relative movement, at a certain point, between the inner cap 223 and the conical surface 314C, so that the continued translation thereafter (once the minor deformation is completed) and corresponding increased biasing force (based upon the spring formula F=kX) then serves to apply a greater contact force between the two parts to encourage better sealing therebetween.

The examples and descriptions provided merely illustrate a preferred embodiment of the present invention. Those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the preferred embodiment without departing from the spirit of this invention as described in the following claims.

We claim:

1. An airtight-sealing cap comprising: a helical spring; an inner cap, said inner cap comprising a first end and a second end, with said first end being open, and said first end comprising an annular convex surface; a shaft, said shaft having a first end fixedly secured to said second end of said inner cap, and said shaft extending therefrom to a second end, said helical spring being slidably received upon said shaft; an outer cap, said outer cap comprising an outer cap member and a cap support member, said cap support member having a first end and a second end, and an interior surface and an exterior surface defining a wall, with said first end being open to said interior surface, said interior surface of said cap support member at said first end comprising an annular lip; said inner cap being received in said open first end of said cap support member, with said shaft being slidably received within an orifice in said wall of said cap support member, said shaft comprising a stop at said second end of said shaft, said helical spring configured to bias said inner cap to travel toward said open first end of said cap support member, said biased travel being limited by said stop of said shaft contacting said wall, said outer cap member having a first end and a second end, said first end of said outer cap member having an opening defining an interior configured to receive said cap support member, said cap support member being fixedly secured to said outer cap member.

2. The airtight-sealing cap according to claim 1 wherein said interior surface at said first end of said inner cap comprises an annular lip configured to be received in a corresponding recess in the applicator head of the cosmetic applicator.

3. A combination airtight-sealing cap and a cosmetic applicator:

said cosmetic applicator comprising:

a body member containing a reservoir of cosmetic product therein; and an applicator head being secured to said body, and comprising a means of delivering said cosmetic product from said body onto an applicator surface of said applicator head;

a portion of said applicator head comprising a tapered surface;

said airtight sealing cap comprising:

an outer cap portion, said outer cap portion comprising a securing means;

a biasing member; and an inner cap member, said inner cap member being received within said outer cap portion and being biased by said biasing member relative to said outer cap; said inner cap member comprising a convex surface;

and wherein when said airtight sealing cap is translated onto said cosmetic applicator, said convex surface of said inner cap member contacts a portion of said tapered surface of said applicator head, and said biasing member biases said inner cap member into airtight contact with said applicator head;

said outer cap portion translating until said securing means is secured to a corresponding securing means on said applicator head.

4. The combination airtight-sealing cap and a cosmetic applicator according to claim 3 wherein said convex surface of said inner cap comprises an annular lip.

5. An airtight-sealing cap, for use with a cosmetic applicator, said airtight-sealing cap comprising:

a helical spring;

an inner cap, said inner cap comprising a first end and a second end, with said first end being open, said second end comprising an annular convex contour; said inner cap comprising a shaft with a first end fixedly secured to said second end of said inner cap, and with said shaft configured to extend to a second end being distal from said first and second ends of said inner cap; said helical spring being slidably received upon said shaft;

an outer cap, said outer cap having a first end and a second end, and an interior surface and an exterior surface, with said first end of said outer cap being open to said interior surface; said interior surface of said outer cap comprising an annular lip proximate to said first end of said outer cap; said outer cap comprising an orifice at said second end;

wherein said inner cap is received through said open first end of said outer cap with said shaft being slidably received within said orifice of said outer cap; said helical spring configured to bias said inner cap to travel toward said open first end of said outer cap, said second end of said shaft comprising a stop means configured to limit said biased travel of said inner cap; and wherein said airtight sealing cap is configured to be translated over a tapered applicator head of the cosmetic applicator, with said convex surface of said inner cap configured to contact a corresponding surface of the applicator head, as said helical spring biases said inner cap into airtight contact with the applicator head, and said annular lip of said outer cap is received by a corresponding recess on the cosmetic applicator to secure said airtight-sealing cap thereto.

* * * * *